US010677106B2

(12) United States Patent
Tawaf et al.

(10) Patent No.: US 10,677,106 B2
(45) Date of Patent: Jun. 9, 2020

(54) ROCKER ARM

(71) Applicant: DELPHI TECHNOLOGIES IP LIMITED, St. Michael (BB)

(72) Inventors: Cynthia A. Tawaf, Rochester, NY (US); Ian R. Jermy, Leroy, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/122,194

(22) Filed: Sep. 5, 2018

(65) Prior Publication Data

US 2020/0072091 A1 Mar. 5, 2020

(51) Int. Cl.
*F01L 1/18* (2006.01)
*F01L 13/00* (2006.01)

(52) U.S. Cl.
CPC ..... *F01L 1/185* (2013.01); *F01L 13/0005* (2013.01); *F01L 13/0015* (2013.01); *F01L 2105/02* (2013.01)

(58) Field of Classification Search
CPC ... F01L 2001/186; F01L 1/46; F01L 13/0005; F01L 2105/00; F01L 2105/02
USPC ..... 123/90.16, 90.41, 90.44
See application file for complete search history.

(56) References Cited

U.S. PATENT DOCUMENTS 6,439,179 B2 8/2002 Hendriksma et al.
6,532,920 B1 3/2003 Sweetnam et al.
6,755,167 B2 * 6/2004 Krieg ..... F01L 1/08 123/90.16
6,976,461 B2 12/2005 Rrig et al.
7,305,951 B2 12/2007 Fernandez et al.
7,673,606 B2 3/2010 Ng et al.
7,798,113 B2 * 9/2010 Fischer ..... F01L 1/185 123/90.39
7,849,828 B2 12/2010 Elnick et al.
8,006,657 B2 8/2011 Riley et al.
2003/0159666 A1 8/2003 Krieg et al.
2005/0132989 A1 * 6/2005 Hendriksma ..... F01L 1/18 123/90.16
2007/0113813 A1 5/2007 Lalone
2015/0128890 A1 * 5/2015 Cecur ..... F01L 1/185 123/90.16
2018/0156140 A1 6/2018 Vance et al.
2018/0320603 A1 11/2018 Vance et al.
2019/0301315 A1 10/2019 Stretch

* cited by examiner

*Primary Examiner* — Jorge L Leon, Jr.
(74) *Attorney, Agent, or Firm* — Joshua M. Haines

(57) ABSTRACT

A rocker arm includes an outer arm with an outer follower including a first outer roller and a second outer roller both supported on an outer arm roller shaft, the outer arm roller shaft having a first portion having a first diameter which is supported in the outer arm by a first outer bearing; a second portion having a second diameter which is supported in the outer arm by a second outer bearing; and a third portion having a third diameter such that the third diameter is smaller than the first diameter and the second diameter. An inner arm selectively pivots relative to the outer arm, the inner arm having an inner follower and also having an inner arm aperture through which the outer arm roller shaft extends such that the third portion of the outer arm roller shaft is located within the inner arm aperture.

12 Claims, 5 Drawing Sheets

ROCKER ARM

TECHNICAL FIELD OF INVENTION

The present invention relates to a rocker arm for valve train of an internal combustion engine; more particularly to a rocker arm with an inner arm which selectively pivots relative to an outer arm; and even more particularly to such a rocker arm where the outer arm includes a pair of rollers supported on a roller shaft which extends through an aperture of the inner arm.

BACKGROUND OF INVENTION

Variable valve activation mechanisms for internal combustion engines are well known. It is known to lower the lift, or even to provide no lift at all, of one or more valves of an internal combustion engine, during periods of light engine load. Such valve deactivation or valve lift switching can substantially improve fuel efficiency.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second and lesser valve lift mode, that is greater than no lift. It should be noted that the second valve lift mode may provide one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm where the inner arm includes an inner arm follower which follows a first profile of a camshaft of the internal combustion engine and where the outer arm includes a pair of outer arm followers which follow respective second and third profiles of the camshaft. The follower of the inner arm and the followers of the outer arm may be either sliding surfaces or rollers and combinations thereof. The inner arm is movably connected to the outer arm and can be switched from a coupled state wherein the inner arm is immobilized relative to the outer arm, to a decoupled state wherein the inner arm can move relative to the outer arm. Typically, the outer arm of the switchable rocker arm is pivotally supported at a first end by the hydraulic lash adjuster which fits into a socket of the outer arm. A second end of the outer arm operates against an associated engine valve for opening and closing the valve by the rotation of an associated eccentric cam lobe acting on the follower of the inner arm. The inner arm is connected to the outer arm for pivotal movement about the outer arm's second end with the follower of the inner arm disposed between the first and second ends of the outer arm. Switching between the coupled state and the decoupled state is accomplished through a lock pin which is slidingly positioned in a lock pin bore of the outer arm. One end of the lock pin is moved into and out of engagement with the inner arm. Consequently, when the lock pin is engaged with the inner arm, the coupled state is achieved. Conversely, when the lock pin is not engaged with the inner arm, the decoupled state is achieved. As shown in U.S. Pat. No. 7,305,951 to Fernandez et al., the disclosure of which is hereby incorporated by reference in its entirety, the other end of the lock pin acts as a piston upon which pressurized oil is applied and vented to affect the position of the lock pin. Also as shown by Fernandez et al., oil is supplied to the lock pin via an oil supply bore which originates in the socket and breaks into the lock pin bore.

It is sometimes desirable for each of the inner arm follower and outer arm followers to be rollers which rotate when engaged with the camshaft in order to minimize friction; various embodiments of which are illustrated in U.S. Pat. No. 6,532,920 to Sweetnam et al. In one implementation shown in FIG. 12 of Sweetnam et al., the outer arm rollers are supported on a common roller shaft which extends through an aperture of the inner arm and through an aperture of an inner arm roller shaft which supports the inner arm roller. However, this implementation suffers from travel of the inner arm being limited by the clearance provided between the outer arm roller shaft and the aperture of the inner arm roller shaft and the roller shaft must be sufficiently large to support the bearing loads. In another implementation disclosed in U.S. Pat. No. 6,976,461 to Rorig et al., and in particular FIG. 3, the outer rollers may be separately supported on individual outer roller shafts, thereby omitting the need for a shaft to extend through the inner arm which would limit travel of the inner arm relative to the outer arm. However, this implementation suffers from increased packaging size of the rocker arm due to the outer rollers each being supported on both lateral sides thereof.

What is needed is a rocker arm which minimizes or eliminates one or more of the shortcomings as set forth above.

SUMMARY OF THE INVENTION

Briefly described, a rocker arm is provided for transmitting rotational motion from a camshaft to opening and closing motion of a combustion valve in an internal combustion engine. The rocker arm includes an outer arm with an outer follower comprising a first outer roller and a second outer roller both supported on an outer arm roller shaft which is centered about, and extends along, an outer arm roller shaft axis about which the first outer roller and the second outer roller rotate, the outer arm roller shaft having 1) an outer arm roller shaft first portion having a first diameter which is supported in the outer arm by a first outer bearing; 2) an outer arm roller shaft second portion having a second diameter which is supported in the outer arm by a second outer bearing; and 3) an outer arm roller shaft third portion having a third diameter such that the third diameter is smaller than the first diameter and is also smaller than the second diameter; an inner arm which selectively pivots relative to the outer arm, the inner arm having an inner follower and also having an inner arm aperture through which the outer arm roller shaft extends such that the outer arm roller shaft third portion is located within the inner arm aperture; a lost motion spring which biases the inner arm to pivot relative to the outer arm in a first direction; and a lock pin which moves between 1) a coupled position in which the lock pin prevents the inner arm from pivoting relative to the outer arm past a predetermined position of the inner arm relative to the outer arm in a second direction which is opposite of the first direction and 2) a decoupled position in which the lock pin permits the inner arm to pivot relative to the outer arm past the predetermined position in the second direction.

The rocker arm with outer arm roller shaft as described herein allows for increased travel of the inner arm relative to the outer arm without increasing the packaging size of the rocker arm and without diminishing the load capacity of the outer arm bearings.

BRIEF DESCRIPTION OF DRAWINGS

This invention will be further described with reference to the accompanying drawings in which.

DETAILED DESCRIPTION OF INVENTION

Figure 1:
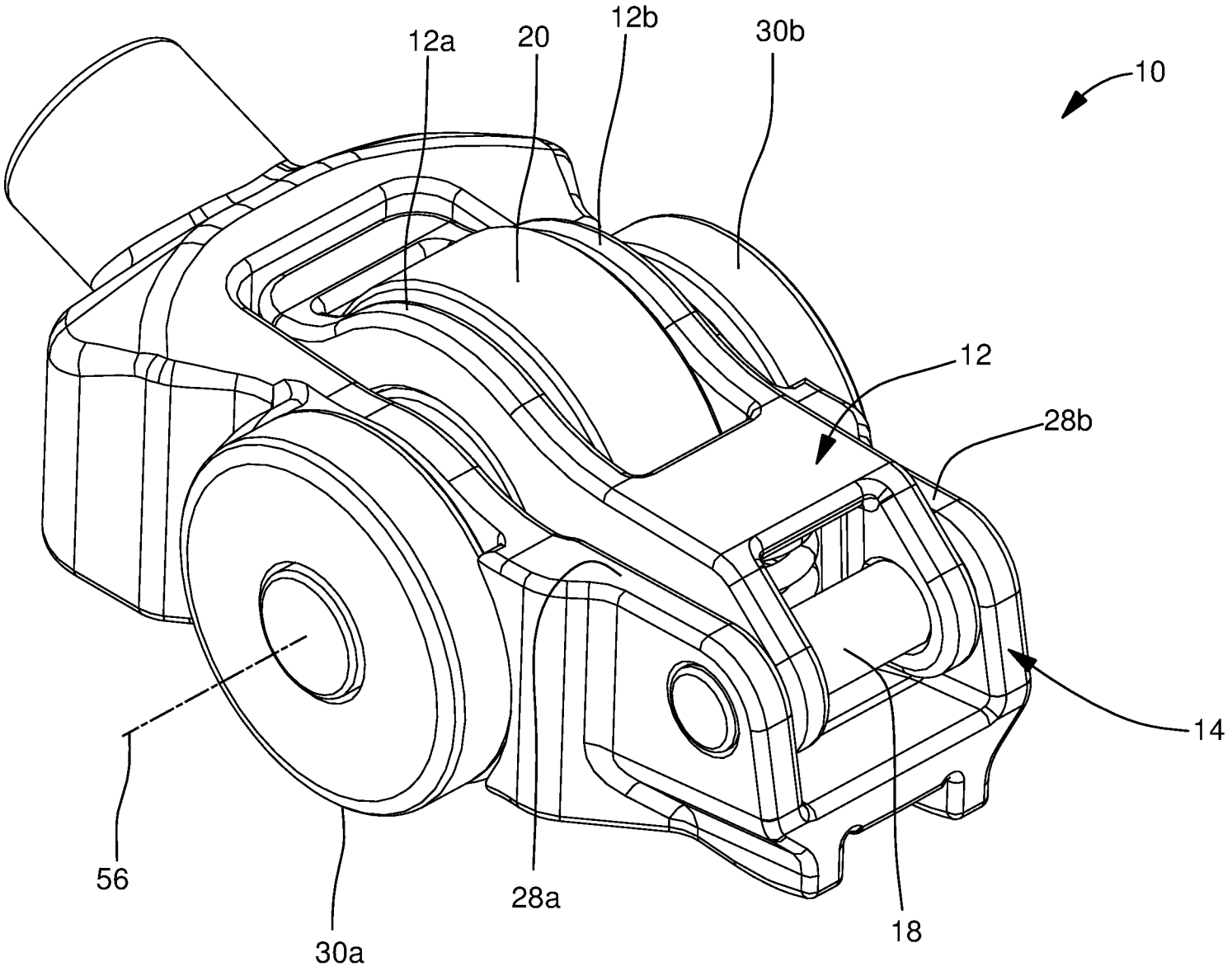
FIG. 1 is an isometric view of a rocker arm in accordance with the present invention.
Figure 2:
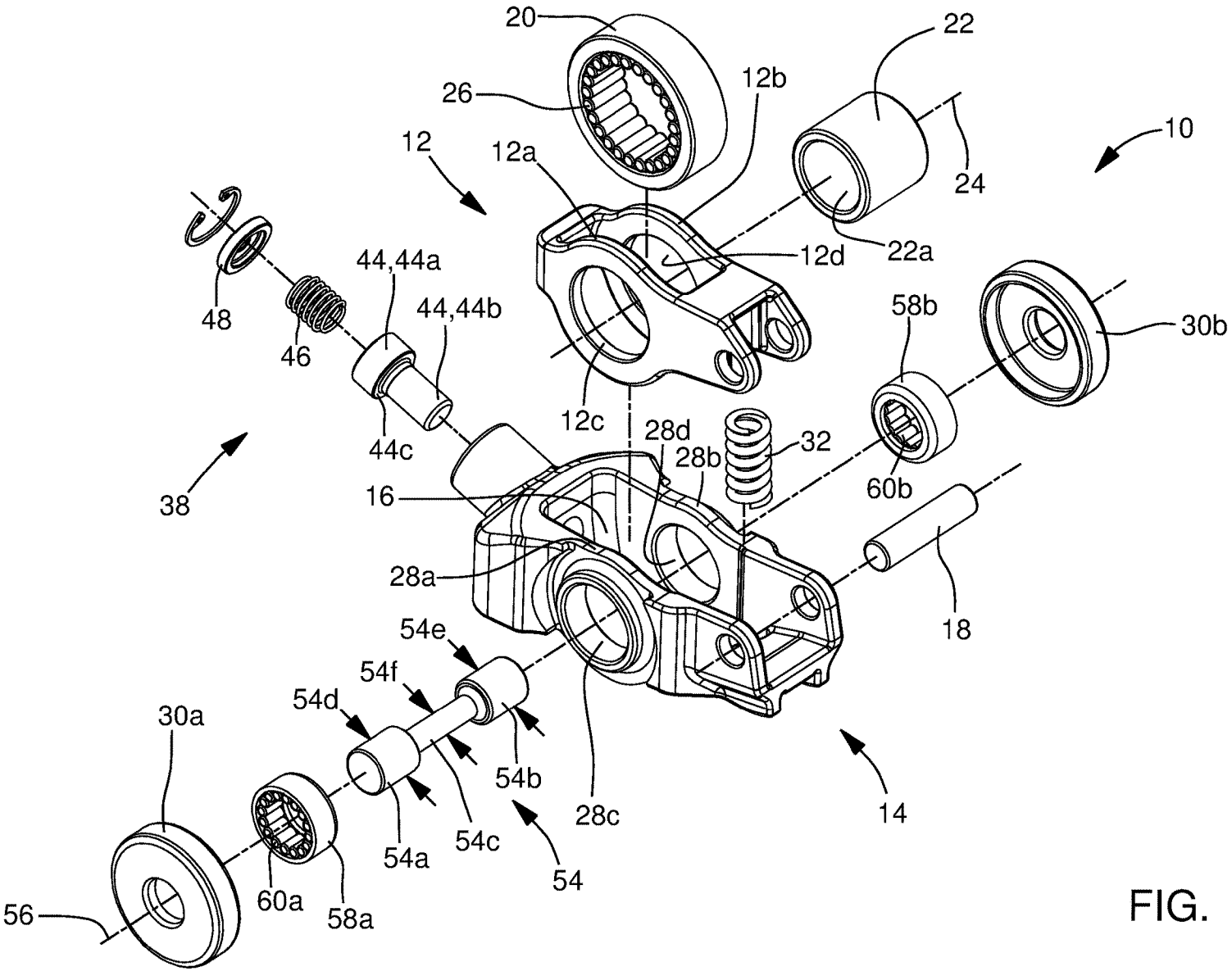
FIG. 2 is an exploded isometric view of the rocker arm of FIG. 1.

Referring to the figures, a rocker arm 10 in accordance with the invention is illustrated where rocker arm 10 is either a two-step rocker arm or a deactivation rocker arm, which may generically be referred to as a switchable rocker arm. Rocker arm 10 is included in valve train (not shown) of an internal combustion engine (not shown) in order to translate rotational motion of a camshaft (not shown) to reciprocating motion of a combustion valve (not shown). Rocker arm 10 includes an inner arm 12 that is pivotably disposed in a central opening 16 in an outer arm 14. Inner arm 12 selectively pivots within outer arm 14 about a pivot shaft 18. Inner arm 12 includes an inner follower illustrated as an inner roller 20 carried by an inner arm roller shaft 22 that is supported by inner arm 12 such that inner roller 20 and inner arm roller shaft 22 are centered about an inner arm roller shaft axis 24. Inner roller 20 is configured to follow the camshaft in order to selectively impart lifting motion on a respective combustion valve. An inner bearing 26 rotatably supports inner roller 20 on inner arm roller shaft 22. Inner bearing 26 may be, for example, a plurality of rollers or needle bearings as shown. Inner arm roller shaft 22 is fixed to inner arm 12, by way of non-limiting example only, by staking each end of inner arm roller shaft 22 in order to cause each end of inner arm roller shaft 22 to be increased in diameter to prevent removal from inner arm 12. In an alternative, inner arm roller shaft 22 may be left to float axially, i.e. along inner arm roller shaft axis 24, while being constrained within central opening 16 by opposing sides of outer arm 14. Outer arm 14 includes an outer arm wall 28*a* and an outer arm wall 28*b* positioned parallel to each other such that outer arm wall 28*a* and outer arm wall 28*b* are perpendicular to inner arm roller shaft axis 24 and such that outer arm wall 28*a* and outer arm wall 28*b* are spaced apart from each other to define central opening 16 therebetween. Outer arm 14 also includes outer followers, illustrated as outer roller 30*a* and outer roller 30*b*, such that outer roller 30*a* is located adjacent to outer arm wall 28*a* outside of central opening 16 and such that outer roller 30*b* is located adjacent to outer arm wall 28*b* outside of central opening 16. Outer roller 30*a* and outer roller 30*b* are configured to follow respective lobes (not shown) of the camshaft, for example low-lift lobes which impart lifting motion on a respective combustion valve or null lobes which do not impart lifting motion on a respective combustion valve. A lost motion spring 32 acts between inner arm 12 and outer arm 14 to pivot inner arm 12 away from outer arm 14 in a first direction illustrated as clockwise in FIGS. 3 and 4. A socket 34 for pivotably mounting rocker arm 10 on a lash adjuster (not shown) is included at a first end 14*a* of outer arm 14 while a pad 36 for actuating a valve stem (not shown) is proximal to a second end 14*b* of outer arm 14. A latching arrangement 38 disposed within outer arm 14 at first end 14*a* thereof selectively permits inner arm 12 to pivot relative to outer arm 14 about pivot shaft 18 and also selectively prevents inner arm 12 from pivoting relative to outer arm 14 about pivot shaft 18. While the follower of inner arm 12 has been illustrated as inner roller 20, it should be understood that the follower of inner arm 12 may alternatively be a sliding surface as shown in U.S. Pat. No. 7,305,951 to Fernandez et al.

Figure 3:
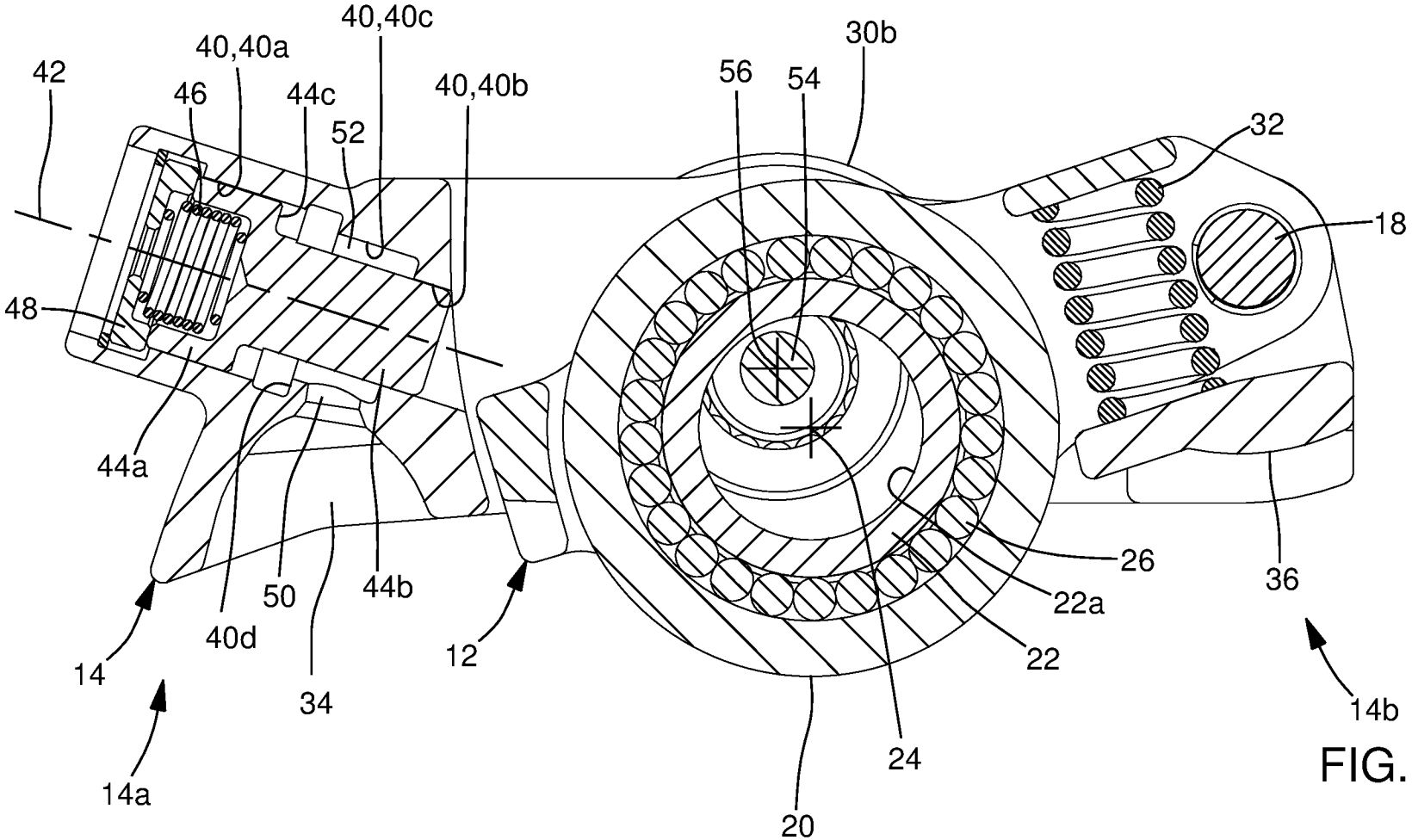
FIG. 3 is a cross-sectional view of the rocker arm of FIG. 1, taken through a plane that is perpendicular to an axis of rotation of a central follower of the rocker arm, showing a latching arrangement of the rocker arm in a decoupled state.
Figure 4:
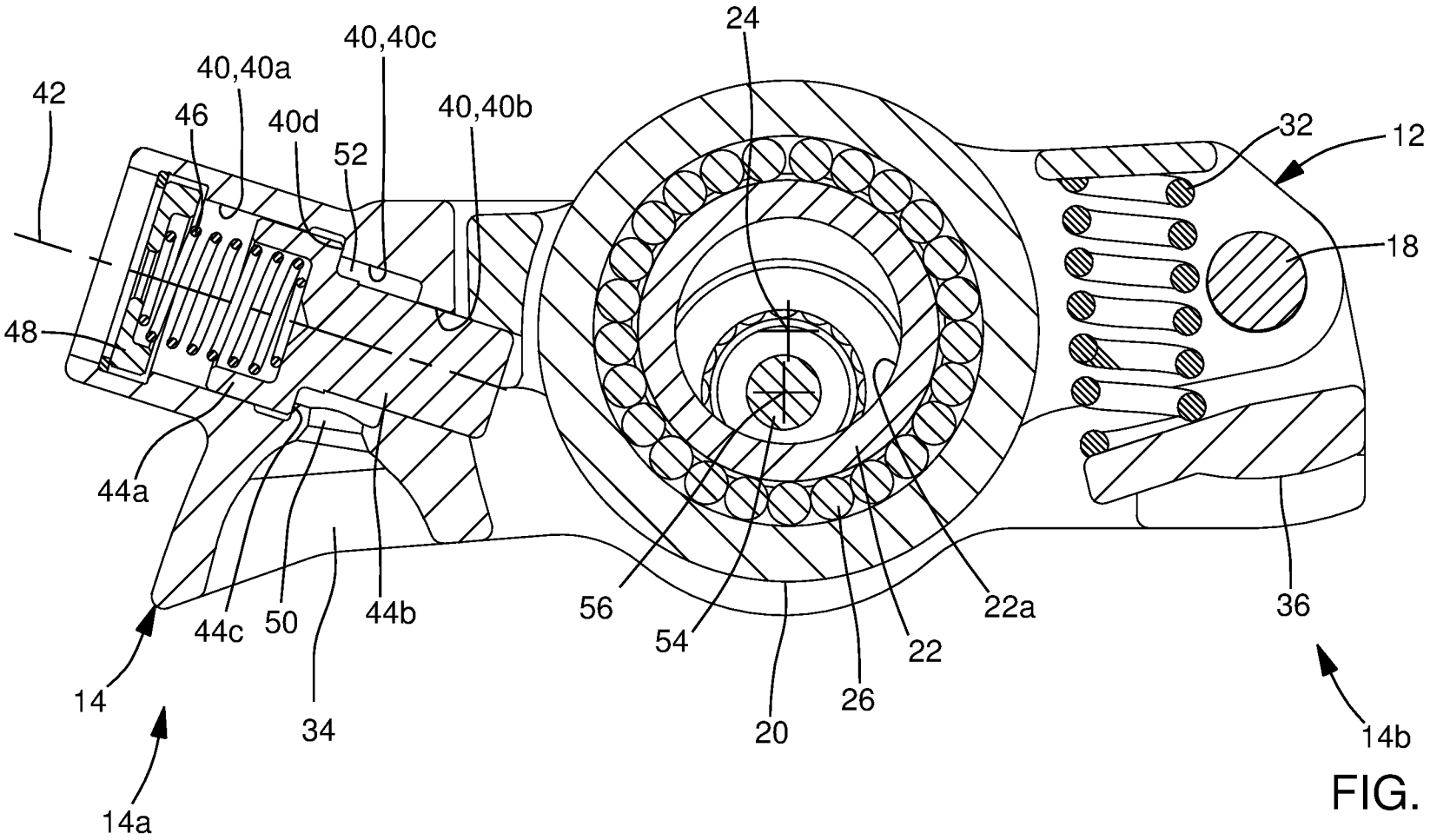
FIG. 4 is the cross-sectional view of FIG. 3, now showing the latching arrangement in a coupled state.
Figure 5:
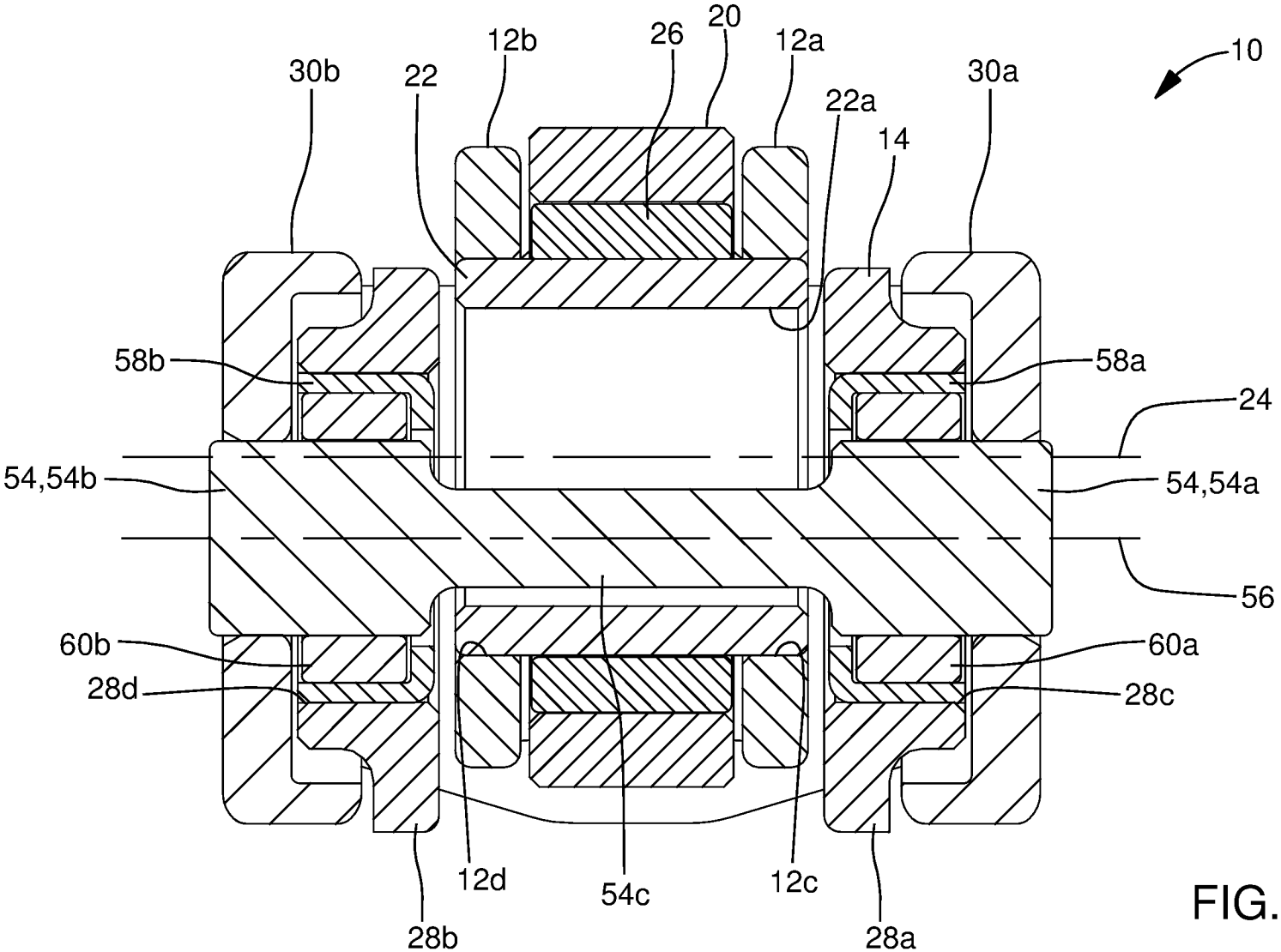
FIG. 5 is a cross-sectional view of the rocker arm of FIG. 1, taken through a plane that is parallel to an axis of rotation of the outer followers of the rocker arm.

Rocker arm 10 is selectively switched between a coupled state and a decoupled state by latching arrangement 38 which is actuated by application and venting of pressurized oil as will be described in greater detail later. In the coupled state as shown in FIG. 4, inner arm 12 is prevented from pivoting relative to outer arm 14 past a predetermined position of inner arm 12 relative to outer arm 14 in a second direction, shown as counterclockwise in FIG. 4 which is opposite in direction to the first direction. In this way, in the coupled state, inner arm 12, and therefore inner arm roller shaft 22, is coupled to outer arm 14, and rotation of the camshaft is transferred from inner roller 20 through inner arm roller shaft 22 to pivotal movement of outer arm 14 about the lash adjuster which, in turn, reciprocates the associated valve. In the decoupled state as shown in FIG. 3, inner arm 12 is able to pivot relative to outer arm 14 past the predetermined position in the second direction. In this way, in the decoupled state, inner arm 12, and therefore inner arm roller shaft 22, is decoupled from outer arm 14. Thus, inner arm roller shaft 22 does not transfer rotation of the camshaft to pivotal movement of outer arm 14, and the associated valve is not reciprocated. Rather, inner arm 12 together with inner roller 20 and inner arm roller shaft 22 reciprocate within central opening 16, thereby compressing and uncompressing lost motion spring 32 in a cyclic manner such that lost motion spring 32 biases inner arm 12 to pivot relative to outer arm 14 in the first direction, shown as clockwise in FIG. 3.

Latching arrangement 38 will now be described in greater detail. Latching arrangement 38 includes a lock pin bore 40 which is centered about, and extends along, a lock pin bore axis 42 into outer arm 14. Latching arrangement 38 also includes a lock pin 44 which is slidably disposed in lock pin bore 40. Lock pin 44 selectively engages inner arm 12, thereby preventing inner arm 12 from pivoting relative to outer arm 14 in the second direction past the predetermined position. Lock pin 44 also selectively disengages inner arm 12, thereby allowing inner arm 12 to pivot relative to outer arm 14 in the second direction past the predetermined position. Latching arrangement 38 also includes a lock pin spring 46 which urges lock pin 44 into engagement with inner arm 12 when desired. Lock pin spring 46 is grounded to outer arm 14 by a lock pin stop 48 which is fixed within lock pin bore 40, for example only, by interference fit and/or a retaining ring. Lock pin spring 46 is captured axially between lock pin stop 48 and lock pin 44. Conversely, pressurized oil is supplied to lock pin 44 through a rocker arm oil passage 50 which extends from socket 34 to lock pin bore 40, thereby compressing lock pin spring 46 and disengaging lock pin 44 from inner arm 12 when desired. The supply of pressurized oil to lock pin 44 may be controlled, for example, by an oil control valve (not shown) which receives oil from an oil supply (not shown) of the internal combustion engine.

Lock pin bore 40 includes three distinct sections, namely a lock pin bore first section 40*a* that is distal from inner arm 12, a lock pin bore second section 40*b* that is proximal to inner arm 12, and a lock pin bore third section 40*c* that is coaxial with, and axially between, lock pin bore first section 40*a* and lock pin bore second section 40*b*. Lock pin bore first section 40*a* is larger in diameter than lock pin bore third section 40*c*, thereby defining a lock pin bore shoulder 40*d* where lock pin bore first section 40*a* meets lock pin bore third section 40*c* such that lock pin bore shoulder 40*d* limits the extent to which lock pin 44 is able to travel toward inner arm 12. As shown, lock pin bore first section 40*a* may itself comprise multiple discrete diameters. Lock pin bore second section 40*b* is smaller in diameter than both lock pin bore first section 40*a* and lock pin bore third section 40*c*.

Lock pin 44 is defined by two distinct sections, namely a lock pin piston section 44*a* which is disposed within lock pin bore first section 40*a* and a lock pin locking section 44*b* which is disposed within lock pin bore second section 40*b* and lock pin bore third section 40*c* under all operating conditions and is also disposed within lock pin bore first section 40*a* when lock pin 44 is not engaged with inner arm 12. Lock pin piston section 44*a* is sized to fit within lock pin bore first section 40*a* in a close sliding fit such that oil is substantially prevented from passing between the interface of lock pin piston section 44*a* and lock pin bore first section 40*a*, radial movement of lock pin piston section 44*a* within lock pin bore first section 40*a* is substantially prevented, and lock pin piston section 44*a* is allowed to move along lock pin bore axis 42 within lock pin bore first section 40*a* substantially uninhibited. Lock pin locking section 44*b* is sized to fit within lock pin bore second section 40*b* in a close sliding fit such that oil is substantially prevented from passing between the interface of lock pin locking section 44*b* and lock pin bore second section 40*b*, radial movement of lock pin locking section 44*b* is substantially prevented, and lock pin locking section 44*b* is allowed to move along lock pin bore axis 42 within lock pin bore second section 40*b* substantially uninhibited. Consequently, a lock pin shoulder 44*c* is defined between lock pin piston section 44*a* and lock pin locking section 44*b*, thereby providing a surface for oil to act upon and also providing a surface to abut lock pin bore shoulder 40*d* to limit travel of lock pin 44 toward inner arm 12. Conversely, the travel of lock pin 44 away from inner arm 12 is limited by lock pin stop 48. Since lock pin bore third section 40*c* is larger in diameter than lock pin bore second section 40*b*, an annular pressure chamber 52 is defined radially between lock pin locking section 44*b* and lock pin bore third section 40*c*. Rocker arm oil passage 50 enters lock pin bore 40 at lock pin bore third section 40*c* such that rocker arm oil passage 50 is located entirely between lock pin bore first section 40*a* and lock pin bore second section 40*b* in order for the oil to be supplied to pressure chamber 52 and have access to lock pin shoulder 44*c*.

While latching arrangement 38 has been illustrated herein as defaulting to the coupled position in the absence of hydraulic pressure, it should now be understood that latching arrangement 38 may alternatively be configured to default to the decoupled position in the absence of hydraulic pressure. This may be accomplished, for example, by reversing the direction which lock pin spring 46 acts upon lock pin 44. Furthermore, while latching arrangement 38 has been illustrated as being actuated based upon hydraulic pressure, other forms of actuation are anticipated, for example, by including a solenoid actuator which affects the position of lock pin 44 based on application of an electric current to the solenoid actuator.

Inner arm 12 together with inner roller 20 and inner arm roller shaft 22 will now be described in greater detail. Inner arm 12 includes an inner arm wall 12*a* and an inner arm wall 12*b* which are parallel to each other such that inner roller 20 is located between inner arm wall 12*a* and inner arm wall 12*b*. Inner arm wall 12*a* includes an inner arm aperture 12*c* extending therethrough such that inner arm aperture 12*c* is centered about, and extends along, inner arm roller shaft axis 24 and such that inner arm aperture 12*c* is cylindrical. Similarly, inner arm wall 12*b* includes an inner arm aperture 12*d* extending therethrough such that inner arm aperture 12*d* is centered about, and extends along, inner arm roller shaft axis 24 and such that inner arm aperture 12*d* is cylindrical. Inner arm roller shaft 22 is received within, and fixed within, inner arm aperture 12*c* and inner arm aperture 12*d*. Inner arm roller shaft 22 may be fixed within inner arm aperture 12*c* and inner arm aperture 12*d*, for example, by deforming the axial ends of inner arm roller shaft 22, i.e. by staking or riveting; welding; interference fit; or combinations thereof. Inner bearing 26, illustrated herein by way of non-limiting example as a plurality of rollers, is located radially between the outer periphery of inner arm roller shaft 22 and the inner periphery of inner roller 20. In this way, inner roller 20 is able to freely rotate about inner arm roller shaft axis 24 in use. Inner arm roller shaft 22 includes an inner arm roller shaft aperture 22*a* extending therethrough such that inner arm roller shaft aperture 22*a* is centered about, and extends along, inner arm roller shaft axis 24 and such that inner arm roller shaft aperture 22*a* connects the axial ends of inner arm roller shaft 22.

Outer arm 14 is provided with an outer arm roller shaft 54 on which both outer roller 30*a* and outer roller 30*b* are supported such that outer arm roller shaft 54 is centered about, and extends along, an outer arm roller shaft axis 56 which is parallel to inner arm roller shaft axis 24. Outer arm roller shaft 54 extends through inner arm roller shaft aperture 22*a*, and consequently, also extends through inner arm aperture 12*c* and inner arm aperture 12*d*. In order to support outer arm roller shaft 54 in outer arm 14, outer arm wall 28*a* is provided with an outer arm wall aperture 28*c* extending therethrough which is centered about outer arm roller shaft axis 56, and similarly, outer arm wall 28*b* is provided with an outer arm wall aperture 28*d* extending therethrough which is centered about outer arm roller shaft axis 56. Also in order to support outer arm roller shaft 54 in outer arm 14, an outer arm bearing race 58*a* is located within, and fixed within, outer arm wall aperture 28*c*, for example by interference fit, and similarly, an outer arm bearing race 58*b* is located within, and fixed within, outer arm wall aperture 28*d*, for example by interference fit. Also in order to support outer arm roller shaft 54 in outer arm 14, an outer bearing 60*a* is located radially between outer arm bearing race 58*a* and outer arm roller shaft 54, and similarly, an outer bearing 60*b* is located radially between outer arm bearing race 58*b* and outer arm roller shaft 54. As illustrated herein, outer bearing 60*a* and outer bearing 60*b* may be a plurality of rollers but may alternatively be a plurality of balls. In an alternative, not shown, outer bearing 60*a* and outer bearing 60*b* may ride directly in outer arm wall aperture 28*c* and outer arm wall aperture 28*d* respectively by omitting outer arm bearing race 58*a* and outer arm bearing race 58*b*.

Outer arm roller shaft 54 includes three distinct portions, namely an outer arm roller shaft first portion 54*a* which is supported by outer bearing 60*a*, an outer arm roller shaft second portion 54*b* which is supported by outer bearing 60*b*, and an outer arm roller shaft third portion 54*c* located between outer arm roller shaft first portion 54*a* and outer arm roller shaft second portion 54*b*. Outer arm roller shaft first portion 54*a* is centered about, and extends along, outer arm roller shaft axis 56 such that outer arm roller shaft first portion 54*a* is cylindrical with diameter 54*d* and is located within outer arm wall aperture 28*c*. Similarly, outer arm roller shaft second portion 54*b* is centered about, and extends along, outer arm roller shaft axis 56 such that outer arm roller shaft second portion 54*b* is cylindrical with diameter 54*e* and is located within outer arm wall aperture 28*d*. Diameter 54*e* is preferably equal to diameter 54*d*. Outer arm roller shaft third portion 54*c* is centered about, and extends along, outer arm roller shaft axis 56 such that outer arm roller shaft third portion 54*c* is cylindrical with diameter 54*f* where diameter 54*f* is smaller than diameter 54*d* and is also smaller than diameter 54*e*. Outer arm roller shaft third portion 54*c* is located within inner arm roller shaft aperture 22*a*, and consequently, outer arm roller shaft third portion 54*c* is located within inner arm aperture 12*c* and inner arm aperture 12*d*. It should be noted that neither of outer arm roller shaft first portion 54*a* and outer arm roller shaft second portion 54*b* are located within inner arm aperture 12*c*, inner arm aperture 12*d*, or inner arm roller shaft aperture 22*a*, and consequently the magnitude of travel of inner arm 12 pivoting relative to outer arm 14 can be as large as accommodated by the size of inner arm roller shaft aperture 22*a* and diameter 54*f* of outer arm roller shaft third portion 54*c* unless limited in some other way.

While inner arm roller shaft aperture 22*a* is illustrated in the figures as being cylindrical with a circular cross-sectional shape when sectioned perpendicular to inner arm roller shaft axis 24, it should be understood that inner arm roller shaft aperture 22*a* may alternatively be non-cylindrical with a cross-sectional shape that is other than circular. For example, the width, i.e. right to left as viewed in FIGS. 3 and 4, may be reduced while allowing the height, i.e. up and down as viewed in FIGS. 3 and 4, to remain the same in order to maintain the travel of inner arm 12 relative to outer arm 14 while increasing the strength of inner arm roller shaft 22.

Rocker arm 10 with outer arm roller shaft 54 as described herein allows for increased travel of inner arm 12 relative to outer arm 14 without increasing the packaging size of rocker arm 10 and without diminishing the load capacity of the outer bearing 60*a* and outer bearing 60*b*. More specifically, since diameter 54*f* of outer arm roller shaft third portion 54*c* is smaller than diameter 54*d* of outer arm roller shaft first portion 54*a* and diameter 54*e* of outer arm roller shaft second portion 54*b*, the clearance between inner arm roller shaft 22 and outer arm roller shaft 54 is increased, thereby increasing the travel permitted of inner arm 12 relative to outer arm 14. Furthermore, since diameter 54*d* of outer arm roller shaft first portion 54*a* and diameter 54*e* of outer arm roller shaft second portion 54*b* are larger than diameter 54*f* of outer arm roller shaft third portion 54*c*, the load capacity of outer bearing 60*a* and outer bearing 60*b* is increased compared to an arrangement were diameter 54*d* and diameter 54*e* would be reduced to match diameter 54*f*.

While this invention has been described in terms of preferred embodiments thereof, it is not intended to be so limited, but rather only to the extent set forth in the claims that follow.

We claim:

1. A rocker arm for transmitting rotational motion from a camshaft to opening and closing motion of a combustion valve in an internal combustion engine, said rocker arm comprising:

an outer arm with an outer follower comprising a first outer roller and a second outer roller both supported on an outer arm roller shaft which is centered about, and extends along, an outer arm roller shaft axis about which said first outer roller and said second outer roller rotate, said outer arm roller shaft having 1) an outer arm roller shaft first portion having a first diameter which is supported in said outer arm by a first outer bearing; 2) an outer arm roller shaft second portion having a second diameter which is supported in said outer arm by a second outer bearing; and 3) an outer arm roller shaft third portion having a third diameter such that said third diameter is smaller than said first diameter and is also smaller than said second diameter;

an inner arm which selectively pivots relative to said outer arm, said inner arm having an inner follower and also having an inner arm aperture through which said outer arm roller shaft extends such that said outer arm roller shaft third portion is located within said inner arm aperture;

a lost motion spring which biases said inner arm to pivot relative to said outer arm in a first direction; and a lock pin which moves between 1) a coupled position in which said lock pin prevents said inner arm from pivoting relative to said outer arm past a predetermined position of said inner arm relative to said outer arm in a second direction which is opposite of said first direction and 2) a decoupled position in which said lock pin permits said inner arm to pivot relative to said outer arm past said predetermined position in said second direction.

2. A rocker arm as in claim 1, wherein said inner follower comprises an inner roller which is supported on an inner arm roller shaft which is centered about, and extends along an inner arm roller shaft axis about which said inner roller rotates, said inner roller being supported on said inner arm roller shaft by an inner bearing located radially between said inner roller and said inner arm roller shaft, said inner arm roller shaft having an inner arm roller shaft aperture extending therethrough within which said outer arm roller shaft third portion is located.

3. A rocker arm as in claim 2, wherein said outer arm roller shaft first portion and said outer arm roller shaft second portion are not disposed within said inner arm roller shaft aperture.

4. A rocker arm as in claim 1, wherein said outer arm roller shaft first portion and said outer arm roller shaft second portion are not disposed within said inner arm aperture.

5. A rocker arm as in claim 1, wherein said outer arm roller shaft third portion is located axially between said outer arm roller shaft first portion and said outer arm roller shaft second portion.

6. A rocker arm as in claim 1, wherein said outer arm roller shaft third portion connects said outer arm roller shaft first portion to said outer arm roller shaft second portion.

7. A rocker arm for transmitting rotational motion from a camshaft to opening and closing motion of a combustion valve in an internal combustion engine, said rocker arm comprising:

an outer arm with an outer follower comprising a first outer roller and a second outer roller both supported on an outer arm roller shaft which is centered about, and extends along, an outer arm roller shaft axis about which said first outer roller and said second outer roller rotate, said outer arm roller shaft having 1) an outer arm roller shaft first portion having a first diameter which is supported in said outer arm; 2) an outer arm roller shaft second portion having a second diameter which is supported in said outer arm; and 3) an outer arm roller shaft third portion having a third diameter such that said third diameter is smaller than said first diameter and is also smaller than said second diameter;

an inner arm which selectively moves relative to said outer arm, said inner arm having an inner arm aperture through which said outer arm roller shaft extends such that said outer arm roller shaft third portion is located within said inner arm aperture;

a lost motion spring which biases said inner arm to move relative to said outer arm in a first direction; and a lock pin which moves between 1) a coupled position in which said lock pin prevents said inner arm from moving relative to said outer arm past a predetermined position of said inner arm relative to said outer arm in a second direction which is opposite of said first direction and 2) a decoupled position in which said lock pin permits said inner arm to move relative to said outer arm past said predetermined position in said second direction.

8. A rocker arm as in claim 7, wherein said inner arm includes an inner follower which comprises an inner roller which is supported on an inner arm roller shaft which is centered about, and extends along an inner arm roller shaft axis about which said inner roller rotates, said inner arm roller shaft having an inner arm roller shaft aperture extending therethrough within which said outer arm roller shaft third portion is located.

9. A rocker arm as in claim 8, wherein said outer arm roller shaft first portion and said outer arm roller shaft second portion are not disposed within said inner arm roller shaft aperture.

10. A rocker arm as in claim 7, wherein said outer arm roller shaft first portion and said outer arm roller shaft second portion are not disposed within said inner arm aperture.

11. A rocker arm as in claim 7, wherein said outer arm roller shaft third portion is located axially between said outer arm roller shaft first portion and said outer arm roller shaft second portion.

12. A rocker arm as in claim 7, wherein said outer arm roller shaft third portion connects said outer arm roller shaft first portion to said outer arm roller shaft second portion.

* * * * *